US007057129B1

(12) United States Patent
Fan et al.

(10) Patent No.: US 7,057,129 B1
(45) Date of Patent: Jun. 6, 2006

(54) MULTI-WAY SYNCHRONOUS SWITCHER

(75) Inventors: Yeping Fan, Shanghai (CN); Wenxin Zhang, Xi'an (CN)

(73) Assignee: Shanghai Guangwei Electric & Tools Factory, Shanghai (CN)

( * ) Notice: Subject to any disclaimer, the term of this patent is extended or adjusted under 35 U.S.C. 154(b) by 0 days.

(21) Appl. No.: 11/060,893

(22) Filed: Feb. 18, 2005

(30) Foreign Application Priority Data

Dec. 7, 2004 (CN) ..... 2004 1 0089194

(51) Int. Cl.
*H01H 19/20* (2006.01)

(52) U.S. Cl. ..... 200/568; 200/537; 200/542; 200/564; 200/573

(58) Field of Classification Search .... 200/16 R–16 F, 200/19.06, 19.13, 19.14, 19.2, 533, 534, 200/537, 538, 540, 542, 564, 568, 569, 573, 200/574
See application file for complete search history.

(56) References Cited

U.S. PATENT DOCUMENTS 3,142,187 A * 7/1964 Kane et al. ..... 74/107

* cited by examiner

*Primary Examiner*—Ramon M. Barrera
(74) *Attorney, Agent, or Firm*—Merchant & Gould P.C.

(57) ABSTRACT

The present invention relates to a multi-way synchronous switcher. The multi-way synchronous switcher comprises a contacting tongue unit and a cam, the contacting tongue unit comprises an upper contacting tongue unit, an intermediate contacting tongue unit and a lower contacting tongue unit which are mounted in sequence; the lower end of the cam has a shape of step provided with several step stages; the first slider being able to move up and down is provided between the cam and the intermediate contacting tongue unit; the lower end of the first slider is connected to an elastic mechanism which can actuate the intermediate contacting tongue unit to move up and down. The multi-way synchronous switcher of the invention can perform multi-way synchronous switching; the knob can be turned in an indicated direction when the switcher is connected in a circuit; the contacting tongues can bear relatively large current, so that it can be damage-proof and has high reliability, small volume, simple structure and low manufacturing cost.

17 Claims, 4 Drawing Sheets

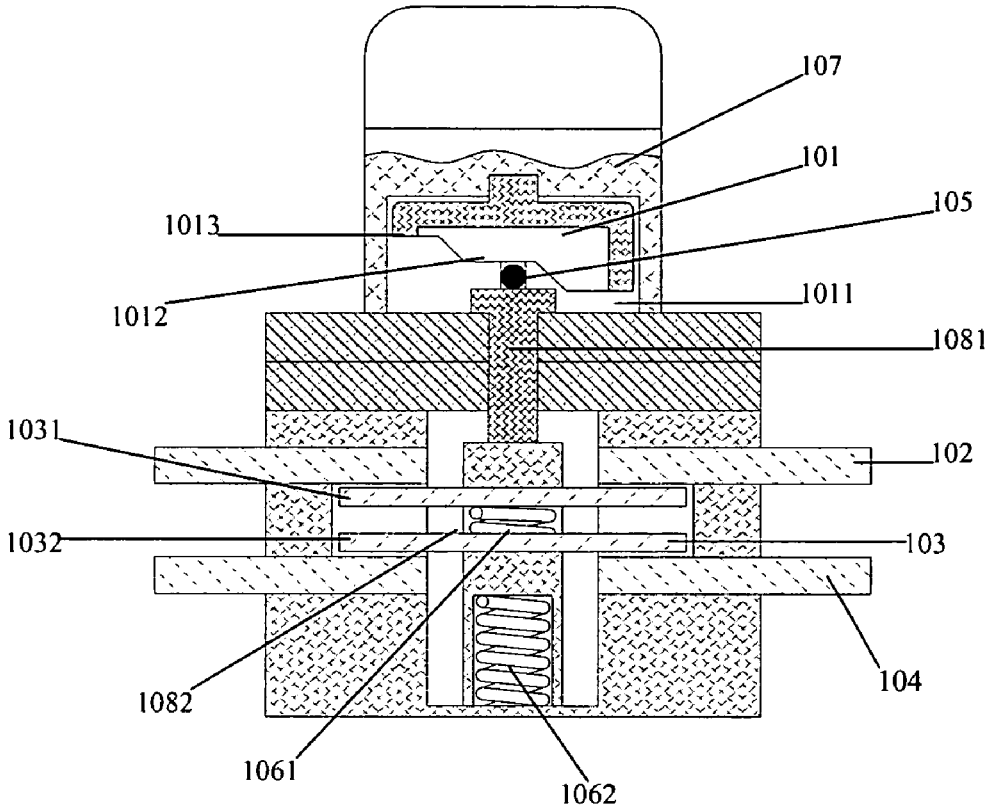
Fig 3
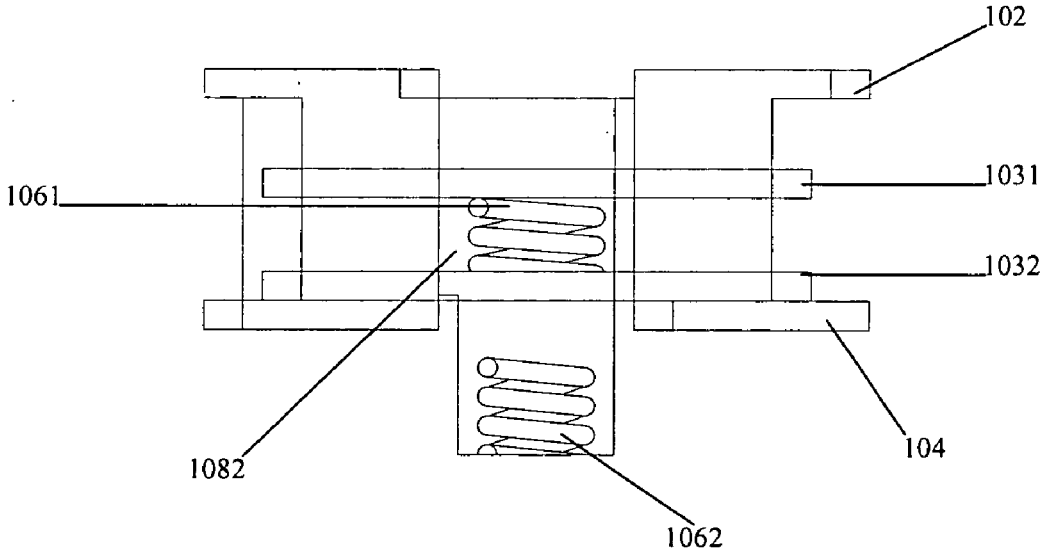
Fig 4-a

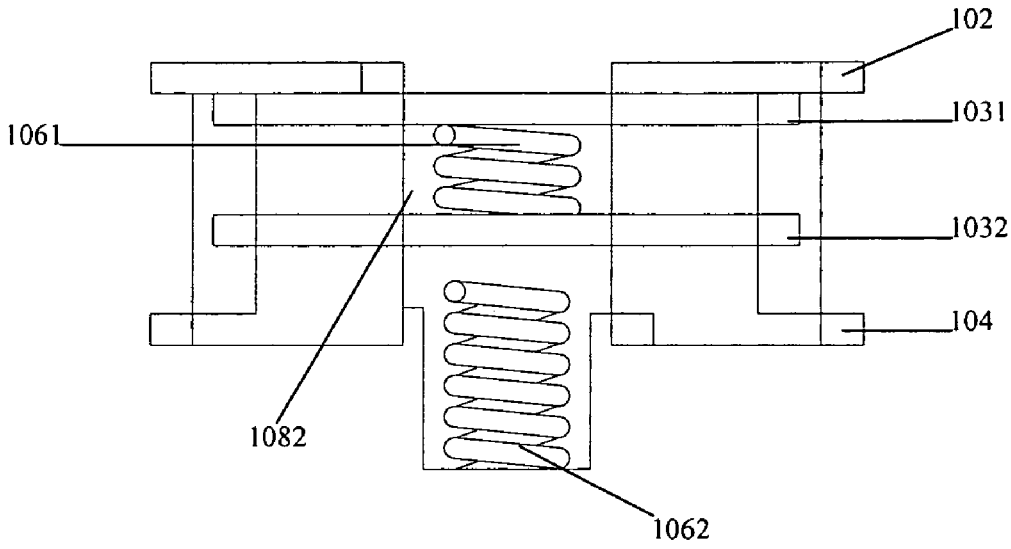
Fig 4-b
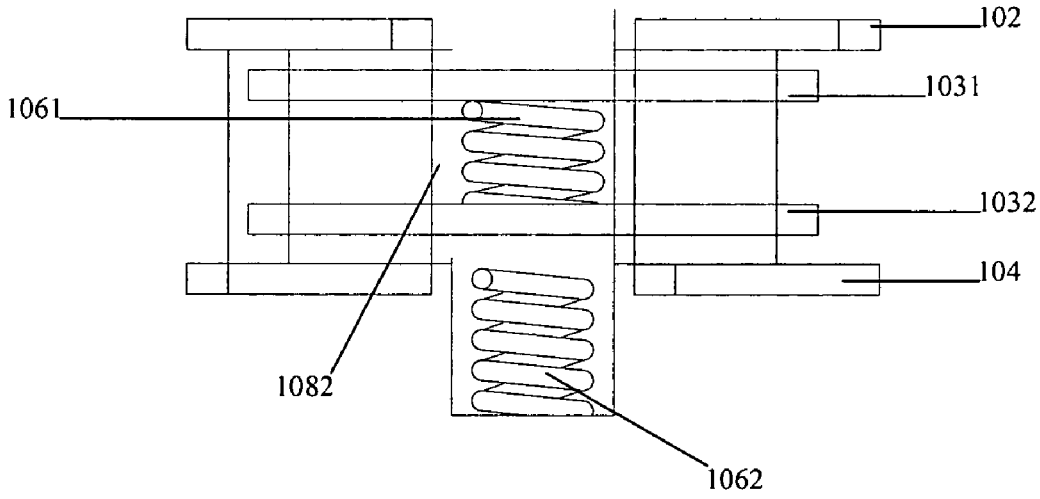
Fig 4-c

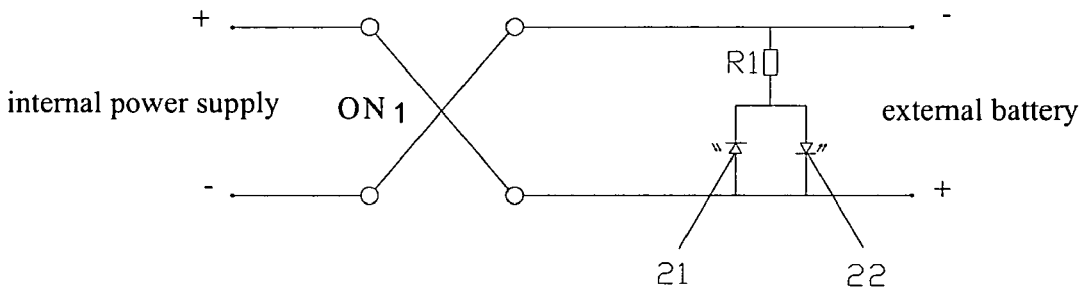
Fig 5-a
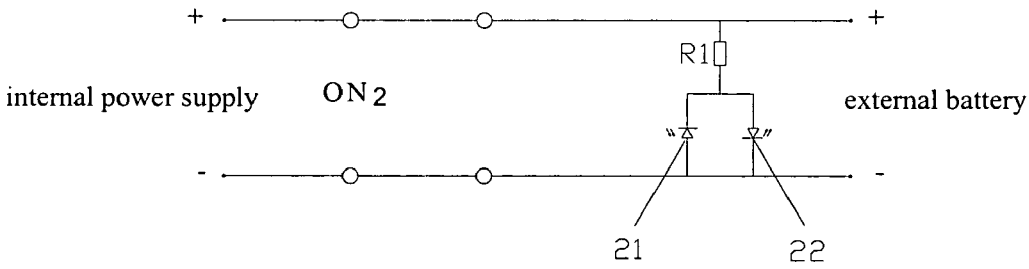
Fig 5-b

MULTI-WAY SYNCHRONOUS SWITCHER

TECHNICAL FIELD

The present invention relates to a multi-way synchronous switcher.

DESCRIPTION OF THE PRIOR ART

Generally, before charging a battery using a charger, it is necessary to distinguish artificially the connection of positive and negative poles. When it is dark to see or the marks of positive and negative poles on the charger are indistinct, it is easy to occur a wrong connection of positive and negative poles, causing the equipment to be damaged.

Recently, some switching devices whose positive and negative poles can be connected arbitrarily are available in markets, which are manufactured according to the controlling principle of miniature relay and have simple structures, but high manufacturing cost and poor reliability.

As shown in FIG. 1, switcher 1' of the background art has contacting tongues 101' with a thin thickness, generally 0.5 mm, and a small width, generally 5 mm, so that it can not bear a large current and may be damaged due to heating of tongues 101' if a large current passes through during charging a battery. In addition, this switcher having a larger volume is fit to an instrument, therefore, another spare space having a thickness of 30 mm must be ready for a new switcher if it is necessary to add a set of new circuit in the instrument during its usage, otherwise, the new switcher will not be fit into the original position for the switcher in the instrument.

As shown in FIG. 2, another switcher 2' of the background art can bear a relatively large current, but it has a large volume and so is cumbersome, therefore, a very large force is required to turn its knob 201' to control the connection of the switcher. Furthermore, the switcher as a whole is not enclosed, so that it can not be fit to an instrument.

SUMMARY OF THE INVENTION

The object of the invention is to provide a multi-way synchronous switcher, which performs synchronous switching through the cam control and has small volume, simple circuit and flexible operation.

In order to achieve above object, the present invention provides a multi-way synchronous switcher comprising a contacting tongue unit and a cam, the contacting tongue unit comprising an upper contacting tongue unit, an intermediate contacting tongue unit and a lower contacting tongue unit which are mounted in sequence;

The cam has a lower end, the lower end of the cam has a shape of step provided with several step stages;

a first slider being able to move up and down is provided between the cam and the intermediate contacting tongue unit;

the first slider has a lower end, the lower end is connected to an elastic mechanism which can actuate the intermediate contacting tongue unit to move up and down;

the intermediate contacting tongue unit comprises several upper intermediate contacting tongues and several lower intermediate contacting tongues which are mounted in sequence;

the second slider being able to move up and down is provided between said upper intermediate contacting tongues and said lower intermediate contacting tongues;

the elastic mechanism comprises a spring connecting the upper intermediate contacting tongues and the lower intermediate contacting tongues and a spring provided in the lower end of the second slider;

the invention comprises a knob provided above the cam.

The multi-way synchronous switcher of the invention has the following advantages:

1. The knob can be turned in the indicated direction when the switcher is connected in a circuit, and the circuit becomes "on", whatever mode, the positive connection mode or the negative connection mode, the switcher is in, not causing the equipment to be damaged.

2. The multi-way synchronous switcher can bear relatively large current, being damage-proof and having high reliability.

3. The multi-way synchronous switcher performs synchronous switching between the contacting tongues through the cam control, that is, the positive connection mode can be switched to the negative connection mode synchronously, or can be switched to the intermediate null mode synchronously.

4. The multi-way synchronous switcher has small volume, simple structure and low manufacturing cost.

The multi-way synchronous switcher of the invention is suitable to the fields of the automobile manufacture and the mechanical and electrical control.

BRIEF DESCRIPTION OF ACCOMPANYING DRAWINGS

FIG. 3 is a schematic diagram of the structure of a multi-way synchronous switcher of the invention;

Figure 1:
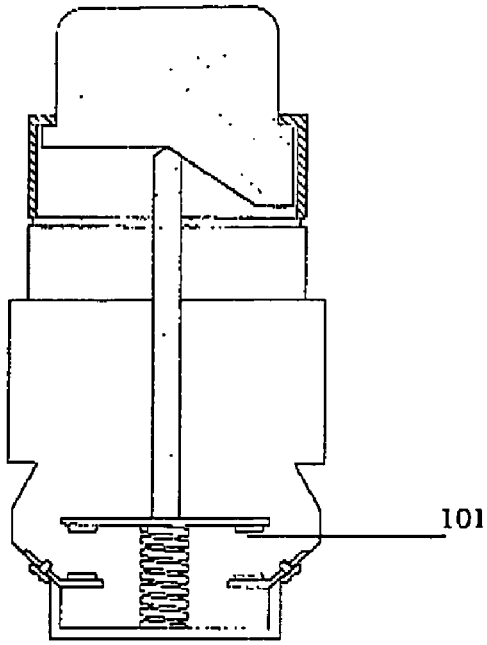
Fig 1 (Prior Art)
FIG. 1 is a switcher of the background art.
Figure 2:
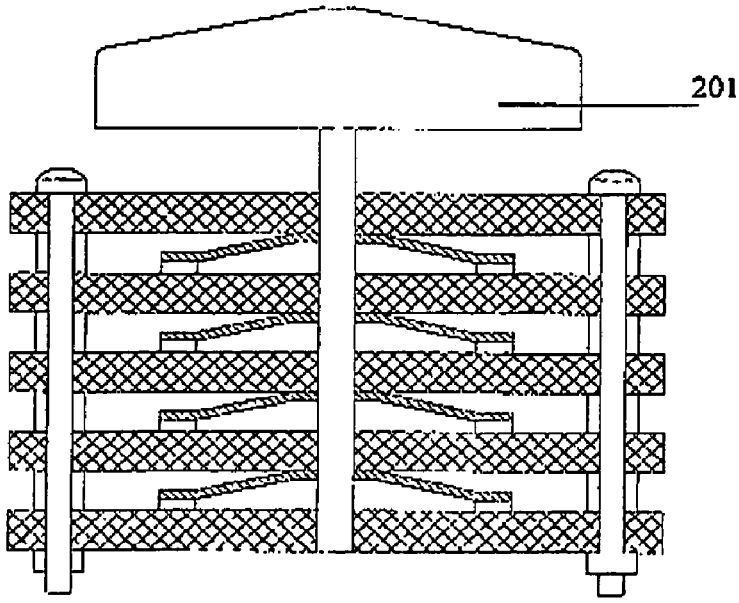
Fig 2 (Prior Art)
FIG. 2 is another switcher of the background art.

FIG. 4-*a* is a schematic diagram of the positive connection mode of the multi-way synchronous switcher of the invention;

FIG. 4-*b* is a schematic diagram of the negative connection mode of the multi-way synchronous switcher of the invention;

FIG. 4-*c* is a schematic diagram of the intermediate null mode of the multi-way synchronous switcher of the invention;

FIG. 5-*a* is a schematic diagram of the operation principle of the multi-way synchronous switcher of the invention in the positive connection mode;

FIG. 5-*b* is a schematic diagram of the operation principle of the multi-way synchronous switcher of the invention in the negative connection mode.

DESCRIPTION IN DETAIL OF THE PREFERRED EMBODIMENT

A preferred embodiment of the present invention will be described according to FIG. 3~FIG. 5 as follows.

FIG. 3 is a schematic diagram of the structure of the multi-way synchronous switcher 1 of the invention. The multi-way synchronous switcher 1 comprises a contacting tongue unit and a cam 101; the lower end of said cam 101 has a shape of step provided with the first step stage 1011, the second step stage 1012 and the third step stage 1013; said contacting tongue unit comprises upper contacting tongue unit 102, intermediate contacting tongue unit 103 and lower contacting tongue unit 104; movable transverse pin 105 being able to move up and down reciprocally is provided between said cam 101 and said intermediate contacting tongue unit 103; a first slider 1081 is provided below movable transverse pin 105.

Said intermediate contacting tongue unit 103 can move up and down, which comprises two upper intermediate contacting tongues 1031 and two lower intermediate contacting tongues 1032, a second slider 1082 being able to move up and down is provided between upper intermediate contacting tongues 1031 and lower intermediate contacting tongues 1032 to ensure that upper intermediate contacting tongues 1031 and lower intermediate contacting tongues 1032 are a certain distance apart; an elastic mechanism comprising spring 1061 and spring 1062 is provided below the first slider, and springs 1061 and 1062 being able to move up and down can actuate two upper intermediate contacting tongues 1031 and two lower intermediate contacting tongues 1032 to move up and down.

The multi-way synchronous switcher of the invention also comprises knob 107 provided above cam 101, and cam 101 can be actuated to turn simultaneously when knob 107 is turned.

The operation principle of the multi-way synchronous switcher of the invention will be described as follows.

As shown in FIG. 4-*c*, when the second step stage 1012 of cam 101 of multi-way synchronous switcher 1 contacts with movable transverse pin 105, upper intermediate contacting tongues 1031 of multi-way synchronous switcher 1 do not contact with upper contacting tongue unit 102, lower intermediate contacting tongues 1032 do not contact with lower contacting tongue unit 104 also, that is, multi-way synchronous switcher 1 is in the intermediate null mode and the circuit becomes "off".

When knob 107 of multi-way synchronous switcher 1 is turned, knob 107 actuates cam 101 to turn synchronously, at this time, if cam 101 presses movable transverse pin 105 downward, movable transverse pin 105 would press the first slider 1081 downward, and the second slider 1082 would be pressed downward also, making whole intermediate contacting tongue unit 103 move down. As shown in FIG. 4-*a*, at this time, lower intermediate contacting tongues 1032 of multi-way synchronous switcher 1 contact with lower contacting tongue unit 104, that is, the switcher is in the positive connection mode and the circuit becomes "on".

As shown in FIG. 4-*b*, when knob 107 is turned in a reverse direction, the third step stage 1013 of cam 107 contacts with movable transverse pin 105, at this time, spring 1062 rebounds in a certain extent and the second slider 1082 moves up simultaneously, so that springs 1061 and 1062 actuate intermediate contacting unit 103 to move up, making upper intermediate contacting tongues 1031 of multi-way synchronous switcher 1 contact with upper contacting tongue unit 102, that is, the switcher is in the negative connection mode and the circuit becomes "on".

Charging external battery by internal power supply can be performed by controlling the connection mode of the multi-way synchronous switcher of the invention in a circuit. FIG. 5-*a* is a schematic diagram of the operation principle of the multi-way synchronous switcher of the invention in the positive connection mode. When the contacts of the switcher are connected as shown in the drawing (ON1), the indicating lamp 21 is illuminated while the other indicating lamp 21 is off, the knob can be turned in the direction indicated by the indicating lamps, making the multi-way synchronous switcher in the positive connection mode, the circuit become "on", and the external battery charged by the internal power supply. FIG. 5-*b* is a schematic diagram of the operation principle of the multi-way synchronous switcher of the invention in the negative connection mode. When the contacts of the switcher are connected as shown in the drawing (ON2), the indicating lamp 22 is illuminated while the other lamp 21 is off, the knob can also be turned in the direction indicated by the indicating lamps, making the multi-way synchronous switcher in the negative connection mode, the circuit also become "on", and the external battery also charged by the internal power supply; the wrong connection of the circuit will never occur, whatever mode, the positive connection mode or the negative connection mode, the multi-way synchronous switcher is in, not causing the circuit components and the equipment to be damaged.

Multi-way synchronous switcher 1 of the present invention has the following advantages:

1. When the multi-way synchronous switcher is connected in a circuit, the knob can be turned in the direction indicated by an indicating lamp, and the circuit can become "on", whatever mode, the positive connection mode or the negative connection mode, the multi-way synchronous switcher is in, not causing the equipment to be damaged.

2. In the contacting tongue units of the multi-way synchronous switcher, the contacting tongues are made of the metal pieces with a relatively large area, so that these contacting tongues can bear a relatively large current because of the relatively large area when the circuit becomes "on", being damage-proof and having high reliability.

3. The multi-way synchronous switcher performs synchronous switching between the contacting tongues through the cam control when knob 107 of the multi-way synchronous switcher is turned, that is, the positive connection mode can be switched to the negative connection mode synchronously, or can be switched to the intermediate null mode synchronously.

4. The multi-way synchronous switcher has simple structure, small volume and low manufacturing cost.

The multi-way synchronous switcher of the invention is suitable to the fields of the automobile manufacture and the mechanical and electrical control.

What is claimed is:

1. A multi-way synchronous switcher, comprising a contacting tongue unit and a cam, the contacting tongue unit comprises an upper contacting tongue unit, an intermediate contacting tongue unit and a lower contacting tongue unit which are mounted in sequence;

said cam has a lower end, the lower end of said cam has the shape of step provided with several step stages;

a first slider being able to move up and down is provided between said cam and said intermediate contacting tongue unit;

said first slider has a lower end, the lower end of said first slider is connected to an elastic mechanism which can actuate the intermediate contacting tongue unit to move up and down; and a movable transverse pin is provided between said cam and said first slider.

2. The multi-way synchronous switcher of claim 1, wherein said intermediate contacting tongue unit comprises several upper intermediate contacting tongues and several lower intermediate contacting tongues which are mounted in sequence.

3. The multi-way synchronous switcher of claim 2, wherein a second slider being able to move up and down is provided between said upper intermediate contacting tongues and said lower intermediate contacting tongues.

4. The multi-way synchronous switcher of claim 1, wherein said elastic mechanism comprises a spring connecting upper intermediate contacting tongues and lower intermediate contacting tongues.

5. The multi-way synchronous switcher of claim 4, wherein said elastic mechanism further comprises a spring provided in the lower end of a second slider.

6. The multi-way synchronous switcher of claim 1, wherein said elastic mechanism further comprises a spring provided in the lower end of a second slider.

7. The multi-way synchronous switcher of claim 1, further comprising a knob provided above the cam.

8. A multi-way synchronous switcher, comprising a contacting tongue unit and a cam, the contacting tongue unit comprises an upper contacting tongue unit, an intermediate contacting tongue unit and a lower contacting tongue unit which are mounted in sequence;

said cam has a lower end, the lower end of said cam has the shape of step provided with a first step stage, a second step stage, and a third step stage;

a first slider being able to move up and down is provided between said cam and said intermediate contacting tongue unit;

said first slider has a lower end, the lower end of said first slider is connected to an elastic mechanism which can actuate the intermediate contacting tongue unit to move up and down; and a movable transverse pin is provided between said cam and said first slider.

9. The multi-way synchronous switcher of claim 8, wherein said intermediate contacting tongue unit comprises several upper intermediate contacting tongues and several lower intermediate contacting tongues which are mounted in sequence.

10. The multi-way synchronous switcher of claim 9, wherein a second slider being able to move up and down is provided between said upper intermediate contacting tongues and said lower intermediate contacting tongues.

11. The multi-way synchronous switcher of claim 8, wherein said elastic mechanism comprises a spring connecting upper intermediate contacting tongues and lower intermediate contacting tongues.

12. The multi-way synchronous switcher of claim 11, wherein said elastic mechanism further comprises a spring provided in the lower end of a second slider.

13. The multi-way synchronous switcher of claim 8, wherein said elastic mechanism further comprises a spring provided in the lower end of a second slider.

14. The multi-way synchronous switcher of claim 8, further comprising a knob provided above the cam.

15. The multi-way synchronous switcher of claim 8, wherein when the second step stage of cam contacts with movable transverse pin, upper intermediate contacting tongues do not contact with upper contacting tongue unit, lower intermediate contacting tongues do not contact with lower contacting tongue unit also, so the multi-way synchronous switcher is in the intermediate null mode.

16. The multi-way synchronous switcher of claim 15, wherein when the first step stage of cam contacts with movable transverse pin, the cam presses movable transverse pin downward, movable transverse pin press the first slider downward, a second slider also be pressed downward, making whole intermediate contacting tongue unit move down, and the lower intermediate contacting tongues contact with lower contacting tongue unit, the switcher is in the positive connection mode.

17. The multi-way synchronous switcher of claim 16, wherein when the third step stage contacts with movable transverse pin, spring rebounds in a certain extent and the second slider moves up simultaneously, so that springs and actuate intermediate contacting unit to move up, making upper intermediate contacting tongues contact with upper contacting tongue unit, the switcher is in the negative connection mode.

* * * * *